US010493328B1

(12) United States Patent
Depcik

(10) Patent No.: US 10,493,328 B1
(45) Date of Patent: Dec. 3, 2019

(54) FOOD VESSEL SPORTS TOY

(71) Applicant: David F Depcik, Naperville, IL (US)

(72) Inventor: David F Depcik, Naperville, IL (US)

( * ) Notice: Subject to any disclaimer, the term of this patent is extended or adjusted under 35 U.S.C. 154(b) by 0 days.

(21) Appl. No.: 16/193,446

(22) Filed: Nov. 16, 2018

Related U.S. Application Data

(60) Provisional application No. 62/707,813, filed on Nov. 20, 2017.

(51) Int. Cl.
*A63B 43/00* (2006.01)
*A63F 9/00* (2006.01)

(52) U.S. Cl.
CPC ..... *A63B 43/002* (2013.01); *A63F 9/00* (2013.01)

(58) Field of Classification Search
CPC ..... A63B 43/002; A63F 9/00
See application file for complete search history.

(56) References Cited

U.S. PATENT DOCUMENTS

| | | | | |
|---|---|---|---|---|
| 2,683,603 A * | 7/1954 | Gackenbach | A63B 65/00 473/596 |
| 3,363,820 A | 1/1968 | Schilling | D7/523 |
| 4,184,682 A | 1/1980 | Collins et al. | 473/613 |
| D259,757 S | 7/1981 | Perrin | D7/15 |
| D259,846 S | 7/1981 | Perrin | D7/509 |
| D282,134 S | 1/1986 | Durand | D7/523 |
| 4,687,210 A | 8/1987 | Michel | 473/595 |
| D297,090 S | 8/1988 | West | D7/523 |
| 4,955,620 A | 9/1990 | Reinke | 473/613 |
| D317,100 S | 5/1991 | Unger | D7/509 |
| D321,813 S | 11/1991 | Unger | D7/509 |
| 5,306,191 A | 4/1994 | Phillips et al. | 473/613 |
| D352,896 S * | 11/1994 | Jones | D9/503 |
| 6,244,980 B1 | 6/2001 | Depcik | 473/613 |
| 9,561,402 B2 * | 2/2017 | Fogarty | A63B 65/00 |

* cited by examiner

*Primary Examiner* — Jeffrey S Vanderveen

(74) *Attorney, Agent, or Firm* — MacCord Mason PLLC

(57) ABSTRACT

Universal throwing and hitting food vessel. In one embodiment, a throwing and hitting toy to receive a foodstuff includes a closed end having a substantially planar bottom, an elastically flexible body with a bottom end having a first thickness and a second thickness that is generally greater than the first thickness, and an outwardly flared rim. Typically, the top end is aligned about 0.75 inches above the closed end. The result is an improved device and method for supporting a food product and subsequently providing variable flight patterns upon throwing.

17 Claims, 7 Drawing Sheets

FOOD VESSEL SPORTS TOY

This application claims the benefit of U.S. provisional application No. 62/707,813, filed Nov. 20, 2017, which is incorporated herein by reference in its entirety.

BACKGROUND

Field

The present disclosure relates generally to food vessels and, more particularly, to a sporting goods food vessel supporting foodstuffs and providing variable flight patterns.

Related Art

Multiuse toys and gadgets allow for the reduction, or even elimination, of redundant pieces and eliminate wastes. A variety of sporting activities involving throwing, catching, and/or hitting a thrown or flying object have become a popular pastime. However, traditional practice and recreational devices to support such sporting activities fail to provide multiuse functions. For instance, traditional practice and recreational devices fail to adequately support foodstuffs prior to delivering sustained sporting use.

Therefore, Applicant desires a food vessel sports device, system, and method of operation without the drawbacks presented by the traditional systems and methods.

SUMMARY

In accordance with the present inventions, food vessel sports toys for throwing and hitting is provided herein. These inventions provide an improved food vessel toy that is convenient, efficient and safe for the user, particularly when used to receive a foodstuff and subsequently in throwing and hitting.

In one embodiment, a food vessel to receive a foodstuff and subsequently throw and hit includes a closed end; a first elastically flexible wall portion that is generally adjacent the closed end and having a first thickness; a second elastically flexible wall portion extending from the first wall portion about 0.75 inches above the closed end and having a second thickness, wherein the second thickness being greater than the first thickness; and an upper outwardly flared rim to receive a corresponding lid, and wherein the vessel consisting essentially of an FDA approved composition.

In one embodiment, a throwing and hitting toy includes a closed end having a substantially planar bottom, an elastically flexible body, wherein the body aerodynamics provide variable flight patterns upon throwing. The elastically flexible body typically has a substantially flat face to provide a hand grip control area. The body may have a bottom end with a first thickness, a top end with a second thickness that is generally greater than the first thickness, and an outwardly flared rim to receive a corresponding lid.

In some examples, the weight distribution of the elastically flexible body is greater than a weight distribution of the closed end. The ratio between a length of the top end and a length of the bottom end may be greater than about two-to-one. The ratio between a diameter of the rim and the closed end is about 2.4.

In another embodiment, a food vessel sports toy includes a vessel to receive a foodstuff and a disposable lid. The vessel may have a closed end, and an elastically flexible, non-constant wall thickness extending from the closed end to an upper rim. Typically, the weight distribution of the non-constant wall thickness is greater than a weight distribution of the closed end. The disposable lid may have a mounting flange to receive the vessel rim. Typically, the vessel and lid sealingly engage to define a foodstuff transport. Typically, the vessel disengages from the lid to expose the foodstuff and define a sports toy comprising aerodynamics, for instance to provide variable flight patterns upon throwing.

In some examples, the upper rim comprises an outwardly flared open end portion. The vessel wall thickness may have a lower portion thickness and an upper portion thickness distinct from the lower portion thickness. The upper portion thickness may be greater than the lower portion thickness. For instance, the upper portion comprises about 0.04 to about 0.08 inch thickness, and the lower portion comprises about 0.03 to about 0.07 inch thickness. In particular examples, the upper portion comprises about 0.06 inch thickness, and the lower portion comprises about 0.05 inch thickness. For instance, the upper portion thickness begins between about 0.6 to about 0.8 inches above the closed end.

In some examples, the upper portion thickness begins about 0.75 inches above the closed, end, or from the bottom of the vessel thereof. The vessel wall may have a length greater than a width of the vessel. In certain examples, the device may include a foodstuff removably secured between the vessel and the lid.

In certain embodiments, the device includes a closed end; a first elastically flexible wall portion adjacent the closed end and having a first thickness; a second elastically flexible wall portion extending from the first wall portion and having a second thickness, wherein the second thickness being greater than the first thickness; and an upper outwardly flared rim to receive a corresponding lid, and wherein the vessel consisting essentially of an FDA approved composition.

In certain examples, the vessel has a weight distribution of a combined first elastically flexible wall portion and the second elastically flexible wall portion that is greater than a weight distribution of the closed end. The rim diameter may be greater than an elastically flexible wall diameter. The second elastically flexible wall portion may begin between about 0.6 to about 0.8 inches above the closed end. The second elastically flexible wall portion may begin about 0.75 inches above the closed end. The device may include a graphic wrap or the like.

In yet another embodiment, a throwing and hitting toy concealing a foodstuff includes a closed end having a substantially planar bottom; and an elastically flexible body having a substantially flat face that provides a hand grip control area, and wherein the body comprising: a bottom end having a first thickness, a top end having a second thickness greater than the first thickness, and an outwardly flared rim adapted to receive a corresponding lid, and wherein the body having aerodynamics adapted to provide variable flight patterns upon the throwing.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1:
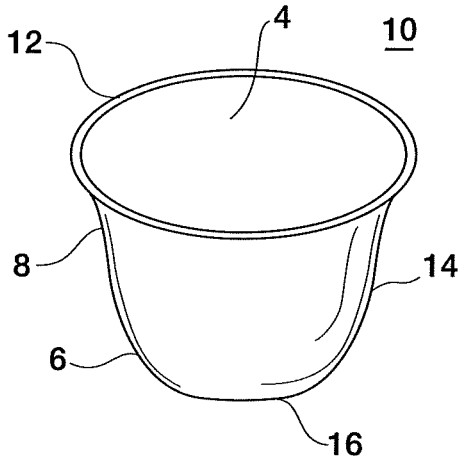
FIG. 1 is a side perspective view of a food vessel toy according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 1A:
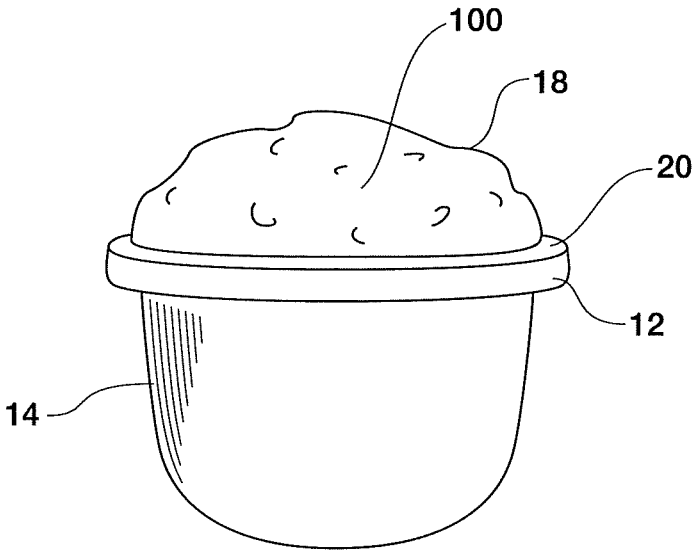
FIG. 1A is a side perspective view of a food vessel toy assembly according to one embodiment of the disclosure.

Referring now to the drawings in general and FIGS. 1 and 1A in particular, it will be understood that the illustrations are for the purpose of describing embodiments of the disclosure and are not intended to limit the disclosure or any inventions thereto. As best seen in FIG. 1, food vessel toy 10 having a cavity 4 provides an improved container to support a foodstuff and subsequently provide aerodynamics for variable flight patterns upon throwing. As illustrated, the food vessel toy 10 has a closed end 16 with upwardly extending elastically flexible, non-constant thickness walls. The non-constant wall thickness includes a first wall portion 6 adjacent closed end 16 having a first thickness, and a second wall portion 8 extending from first wall portion 6 and having a second thickness that is generally greater than the first thickness. As shown and described herein, Applicant has unexpectantly discovered the relationship of the first wall portion 6 about the second wall portion 8 provides structurally integrity of a food container to accept lids without a thicker defined lip and in its use as a sports toy to withstand impact of being struck by a bat, while providing improved variable flight aerodynamic performance.

As shown in FIG. 1, the throwing and hitting vessel is substantially cup-shaped with a cavity 4 to receive foodstuffs 100 (as illustrated in FIG. 1A) and includes generally a flared open end portion 12, a body portion 14, and a closed end portion 16. The body portion 14 is typically cylindrically shaped and analogous to the sidewalls of a cup to support the various foodstuffs as shown and described herein.

Any of the body portion vessels may be formed from United States Food and Drug Administration approved food safe materials, including, but not limited to, plastics, resins, and the like to support any variety of foodstuffs and similar elements, but also provide structural rigidity and elasticity for variable flight aerodynamics. FIG. 1A illustrates one embodiment of vessel and lid 18 in a closed operating position. As shown, lip 20 of the lid 18 removably engages the flared rim 12 of body 14 to enclose foodstuff 100, for instance in a first operating position. Unexpectantly, Applicant has discovered, as later shown in FIGS. 2 and 3, the second wall 8 has a second thickness to retain lid 18 in the removably fixed position without the need for a thicker additional lip. Those of ordinary skill in the art will recognize additional lid and vessel arrangements and orientations, as well as any variety of foodstuff components.

In particular examples, lid 18 has a generally circular periphery to mate with the respective flared rim shown and described herein, for instance along an annular sidewall to generally form a seal between the annular sidewall and flared rim. In some embodiments, the thickness of the material of the lid may be selected to provide satisfactory strength while enabling enough flexibility to facilitate gripping engagement of the flared rim of the vessel by the gripping portion of the lid. However, any suitable lid design, geometry, material, and dimensions may mate with any of the corresponding vessels herein. In further alternative examples, lid 18 may have a drinking opening, for instance adjacent the periphery to enable drinking from the vessel assembly. In one embodiment, lid 18 may be constructed of a one-piece plastic construction. For instance, lid 18 may be manufactured by a thermoforming operation, such as by vacuum forming or the like. In particular embodiments, the resulting lid/cup assembly may be leak resistant in accordance with a leak resistant test and drop resistant in accordance with a roll test, drop test, or the like.

Figure 2:
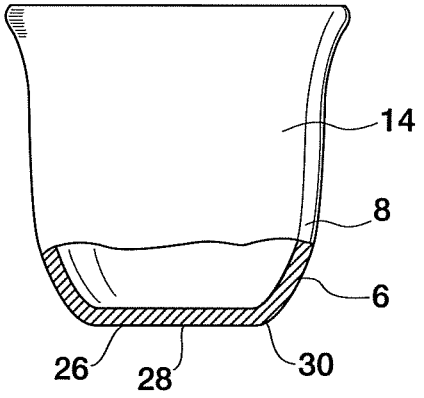
FIG. 2 is a partial cut-away side view of the embodiment of FIG. 1.
Figure 3:
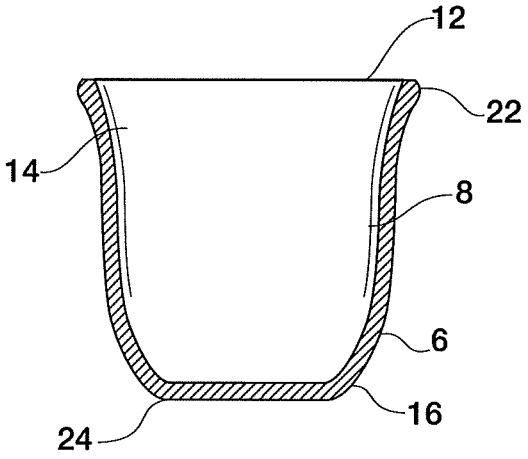
FIG. 3 is a cross-sectional side view of the embodiment of FIG. 1.
Figure 4:
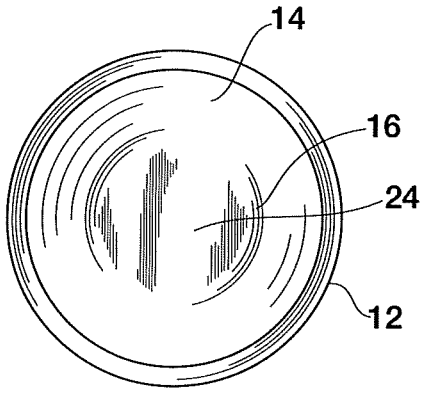
FIG. 4 is a top plan view of the embodiment of FIG. 1.
Figure 5:
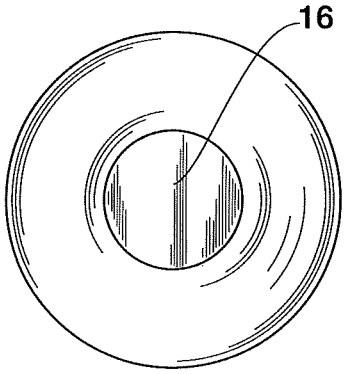
FIG. 5 is a bottom plan view of the embodiment of FIG. 1.

FIGS. 1 and 2 introduce internal elements of the vessel that provides the foodstuff-receiving cavity 4 improvements and the variable flight patterns. And as further shown in FIG. 3, flared rim 22 is generally of a greater circumference than body portion 14, which improves the variable flight patterns. In particular embodiments, the closed end portion 16 has a substantially planar bottom portion 24. Further, in particular examples the closed end portion 16 may have an indented bottom portion 26, for instance with a flat planar wall portion 28 having a thickness less than a bottom rim portion 30.

In particular embodiments, the diameter of the body portion 14 is about 2.0-2.5 (in particular about 2.4) inches, the diameter of the flared open end is about 3.0 inches. The wall thickness is non-uniform to provide the various foodstuff container structural support and variable flight pattern improvements. For instance, in one embodiment upper portion 8 comprises about 0.04 to about 0.08 inch thickness, whereas the lower portion comprises about 0.03 to about 0.07 inch thickness. Still further, in particular embodiments the upper portion 8 comprises about 0.06 inch thickness, and lower portion 6 comprises about 0.05 inch thickness. As shown and described herein, Applicant has discovered unexpected variable flight pattern improvements wherein upper portion 8 begins between about 0.6 to about 0.8 inches above closed end 16. In particular embodiments, the upper portion 8 begins about 0.75 inches above closed end 16 of the bottom of the vessel thereof. However, those skilled in the art having the benefit of this disclosure will recognize size and shape refinements such that the vessel retains its intended use characteristics as a throwing and hitting food support vessel toy having the advantages as set forth herein.

In one embodiment, the vessel 10 includes a closed end 16; a first elastically flexible wall portion 6 that is generally adjacent closed end 16 and has a first thickness. The vessel 10 includes a second elastically flexible wall portion 8 that extends from first wall portion 6 at a height of about 0.75 inches above closed end 16. The second elastically flexible wall portion 8 has a second thickness that is distinct, i.e. non-uniform, from the first thickness, for instance being greater than the first thickness. Additionally, the vessel 10 includes an upper outwardly flared rim 22 to removably receive a corresponding lid.

In yet another embodiment, a food vessel sports toy includes a vessel having a closed end 16, an elastically flexible, non-constant wall thickness extending from closed end 16 to an upper rim 22. The weight distribution of the non-constant wall thickness is greater than a weight distribution of closed end 16. The vessel includes cavity 4 defined between closed end 16 and the elastically flexible, non-constant walls to receive at least one, but including more than one, foodstuff. The food vessel sports toy may include a disposable lid 18 having a mounting flange 20 that receives vessel rim 22. The vessel 10 and lid 18 may sealingly engage to enclose cavity 4 and any foodstuffs 100. Further, vessel 10 may subsequently disengage from lid 18 to expose foodstuff 100, of the like, and define a sports toy comprising any of the aerodynamics that provide the variable flight patterns shown and described herein.

Figure 7:
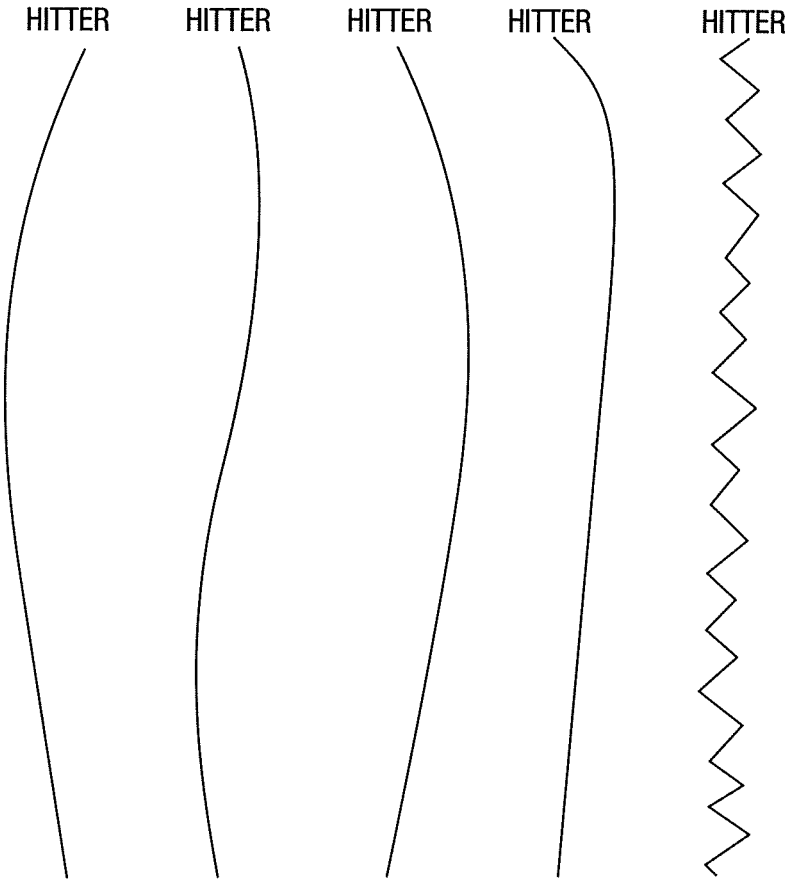
FIG. 7 is an overview of flight patterns exhibited by the embodiment of FIG. 1.
Figure 8A:
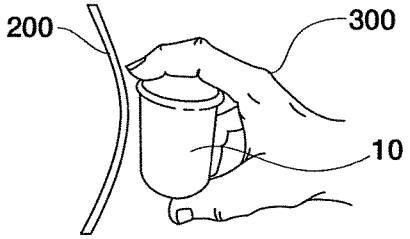
FIG. 8A is an example of the embodiment of FIG. 1 in an operational position.
Figure 8B:
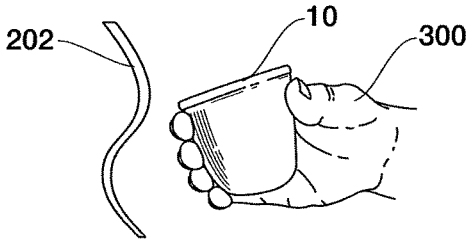
FIG. 8B is an example of the embodiment of FIG. 1 in an operational position.
Figure 8C:
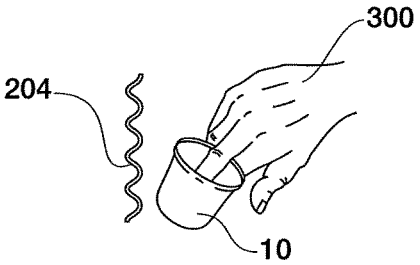
FIG. 8C is an example of the embodiment of FIG. 1 in an operational position.
Figure 8D:
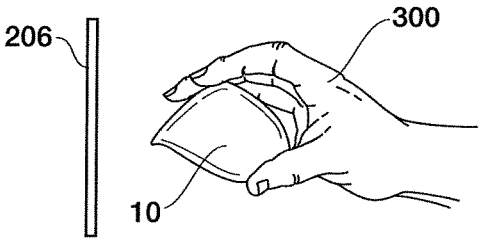
FIG. 8D is an example of the embodiment of FIG. 1 in an operational position.
Figure 8E:
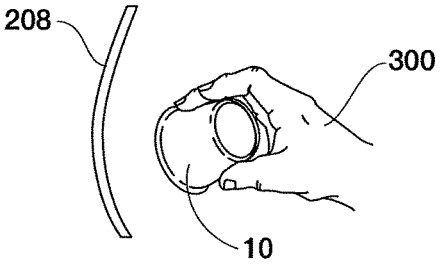
FIG. 8E is an example of the embodiment of FIG. 1 in an operational position.

Any of the vessel embodiments and examples herein may vary with respect to the intended use of the food vessel toy. Due to the aerodynamics provided by the vessel, particularly due to the weight distribution and flared open end, the vessel when thrown with varying spin, velocity, and position can exhibit flight patterns such as shown FIG. 7. As illustrated, one end of the vessel is open and the other end closed, thus the weight distribution is greater near the closed end. In use, the invention is thrown and the weight distribution and the aerodynamics of the invention result in rotation, flipping, or turning of the vessel such that, in particular embodiments, the closed end portion 16 is the lead end in flight. Therefore, the vessel features allow for the development of skill and thus competitive ability progression. FIG. 8A introduces a user 300 positioned to deliver a curve pitch 200 as recognized by those skilled in the art having the benefit of this disclosure. FIG. 8B introduces a user 300 positioned to deliver a double curve pitch 202 as recognized by those skilled in the art having the benefit of this disclosure. FIG. 8C introduces a user 300 positioned to deliver a flutter pitch 204 as recognized by those skilled in the art having the benefit of this disclosure. FIG. 8D introduces a user 300 positioned to deliver a changeup pitch 206 as recognized by those skilled in the art having the benefit of this disclosure. FIG. 8E introduces a user 300 positioned to deliver a screwball pitch 208 as recognized by those skilled in the art having the benefit of this disclosure.

The effective variable flight patterns of the vessel upon throwing is a crucial aspect of the present inventions. In particular, the effective differential of wall thicknesses is a crucial aspect of the variable flight patterns of the vessel. For instance, the effective location of the differentiation of wall thicknesses has a dramatic effect on curving pitch flight patterns. If the top wall thickness is aligned too far from the closed end, the lower portion being relatively heavier than the walls effectively makes the closed end dip too quickly and too sharply upon throwing. The result is an early, sharp, and uncontrollable curve flight pattern. Further, a top wall thickness aligned too far from the base reduces, or even eliminates, a double curve flight pattern. Alternatively, a top wall thickness aligned too near the closed end produces a relatively light base portion compared to the heavier wall portion causing the base to dip later and less in flight, therefore diminishing the curve flight pattern. In addition, a top wall thickness aligned too near the closed end prolongs to double curve, i.e. curves less early in flight.

Figure 6:
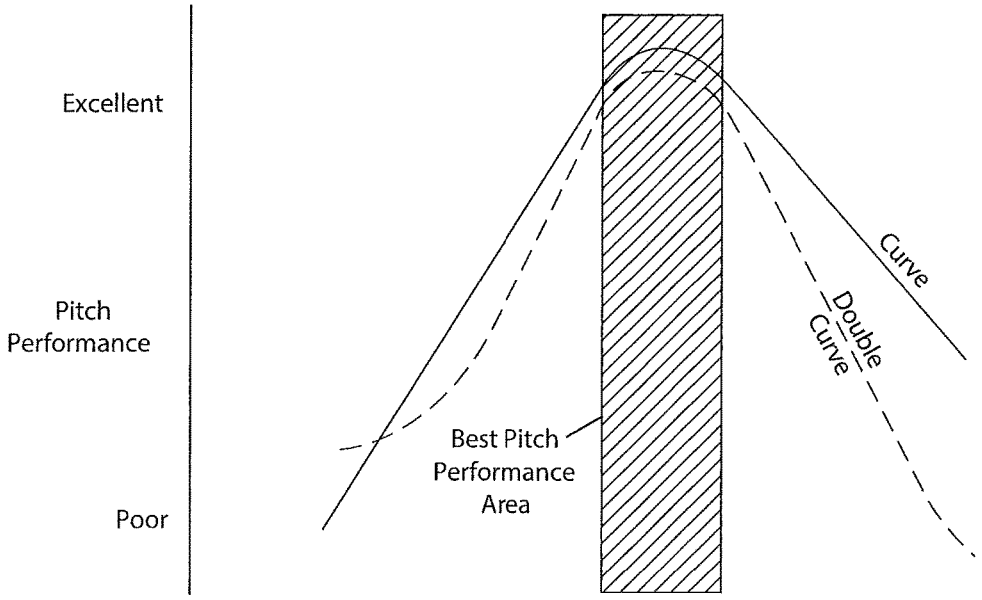
FIG. 6 is a surface response curve indicating variable flight aerodynamic performance of the embodiment of FIG. 1.
Figure 6A:
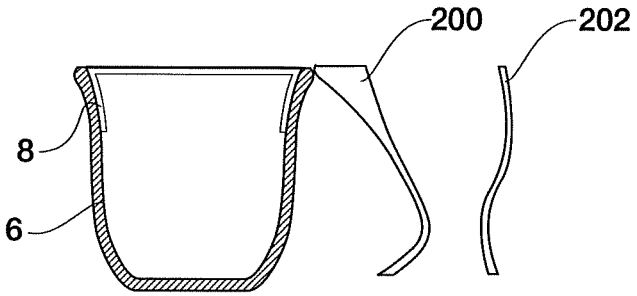
FIG. 6A is an alternative embodiment of a vessel with two common flight pattern orientations exhibited by the embodiment.
Figure 6B:
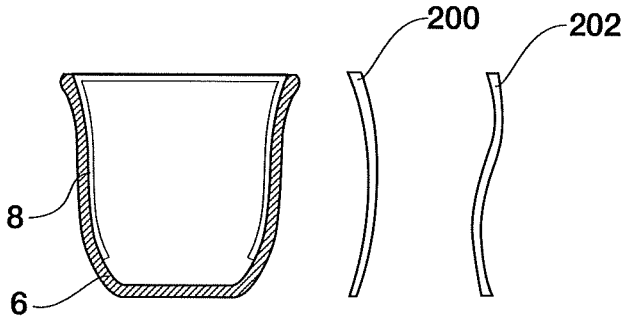
FIG. 6B is an alternative embodiment of a vessel with two common flight pattern orientations exhibited by the embodiment.

Extensive experimentation was necessary to achieve both effective variable flight patterns and structural durability to support a foodstuff. FIG. 6 quantifies overall performance shown and described herein. Therefore, it is desirable that the second elastically flexible wall portion begins between about 0.6 to about 0.8 inches above the closed end to provide the effective variable flight patterns shown and described herein. It is even more desirable that the second elastically flexible wall portion begins about 0.75 inches above the closed end to provide the effective variable flight patterns shown and described herein.

Figure 6C:
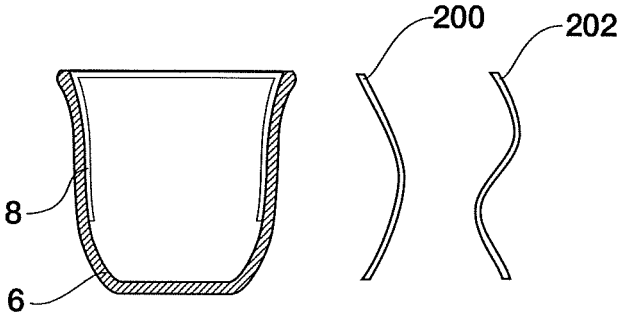
FIG. 6C is the embodiment of FIG. 1 with two common flight pattern orientations exhibited by the embodiment.

As demonstrated in the following prophetic tables and FIGS. 6-6C, the effective positioned differential of wall thicknesses between the first elastically flexible wall portion and the second elastically flexible wall portion is a crucial aspect of the variable flight patterns of the body, particularly in curve flight pattern 200 and double curve flight pattern 202.

TABLE 1

| Effective Curve Flight Pattern | | | | | | |
|---|---|---|---|---|---|---|
| % of | 80 | 1 | 2 | 4 | 5 | 3 |
| Weight | 60 | 1 | 2 | 4 | 5 | 3 |
| Distribution | 40 | 1 | 2 | 4 | 5 | 3 |
| | 20 | 1 | 2 | 4 | 5 | 3 |
| | 0 | 1 | 2 | 4 | 5 | 3 |
| | | 0.25 | 0.5 | 0.75 | 1.5 | 2.5 |
| | | Distance to Wall Thickness (Inches) | | | | |

In this table, a rating of 1 indicates a curve flight pattern that is unacceptable, whereas an opposing rating of 5 indicates excellent performance.

TABLE 2

| Effective Double Curve Flight Pattern | | | | | | |
|---|---|---|---|---|---|---|
| % of | 80 | 1 | 2 | 4 | 4 | 3 |
| Weight | 60 | 1 | 2 | 4 | 4 | 3 |
| Distribution | 40 | 1 | 2 | 4 | 4 | 3 |
| | 20 | 1 | 2 | 4 | 4 | 3 |
| | 0 | 1 | 2 | 4 | 4 | 3 |
| | | 0.25 | 0.5 | 0.75 | 1.5 | 2.5 |
| | | Distance to Wall Thickness (Inches) | | | | |

In this table, a rating of 1 indicates a double curve flight pattern that is unacceptable, whereas an opposing rating of 5 indicates excellent performance.

TABLE 3

| Effective Point of Curve Initiation along Flight Pattern | | | | | | |
|---|---|---|---|---|---|---|
| % of | 80 | 5 | 4 | 3 | 2 | 1 |
| Weight | 60 | 5 | 4 | 3 | 2 | 1 |
| Distribution | 40 | 5 | 4 | 3 | 2 | 1 |

TABLE 3-continued

| Effective Point of Curve Initiation along Flight Pattern | | | | | |
|---|---|---|---|---|---|
| 20 | 5 | 4 | 3 | 2 | 1 |
| 0 | 5 | 4 | 3 | 2 | 1 |
| | 0.25 | 0.5 | 0.75 | 1.5 | 2.5 |
| | Distance to Wall Thickness (Inches) | | | | |

In this table, a rating of 1 indicates location of movement from a centerline of the flight at a proximate portion of the length of flight (i.e. early), whereas a rating of 5 indicates movement from the centerline at an opposing distal portion of flight (i.e. late). As used herein, percent weight distribution shall refer to a distribution of the overall weight with respect to the longer and shorter wall portions.

TABLE 4

| Effective Point of Double Curve Initiation along Flight Pattern | | | | | | |
|---|---|---|---|---|---|---|
| % of | 80 | 1 | 2 | 3 | 4 | 4 |
| Weight | 60 | 1 | 2 | 3 | 4 | 4 |
| Distribution | 40 | 1 | 2 | 3 | 4 | 4 |
| | 20 | 1 | 2 | 3 | 4 | 4 |
| | 0 | 1 | 2 | 3 | 4 | 4 |
| | | 0.25 | 0.5 | 0.75 | 1.5 | 2.5 |
| | | Distance to Wall Thickness (Inches) | | | | |

In this table, a rating of 1 indicates location of movement from a centerline of the flight at a proximate portion of the length of flight (i.e. early), whereas a rating of 5 indicates movement from the centerline at an opposing distal portion of flight (i.e. late). As used herein, percent weight distribution shall refer to a distribution of the overall weight with respect to the longer and shorter wall portions.

In other embodiments, the disclosure includes a food vessel sports toy kit. In such an embodiment, the kit may comprise a vessel, e.g. any of the vessel elements and components previously shown or described. Further, other embodiments of the kit may comprise a lid, e.g. any of the lid elements and components previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size and arrangement of parts, within the principle of the disclosure, to the full extent indicated by the broad general meaning of the terms in which the general claims are expressed. It is further noted that, as used in this application, the singular forms "a," "an," and "the" include plural referents unless expressly and unequivocally limited to one referent.

What I claim is:

1. A food vessel sports toy, said assembly comprising:

a. a vessel having:

i. a closed end, ii. an elastically flexible, non-constant wall thickness extending from said closed end to an upper rim, wherein a weight distribution of said non-constant wall thickness being greater than a weight distribution of said closed end, and wherein an upper portion comprises 0.04 to 0.08 inch thickness and a lower portion comprises 0.03 to 0.07 inch thickness distinct from said lower portion thickness, and iii. a cavity defined between said closed end and said elastically flexible, non-constant walls adapted to receive a foodstuff; and b. a disposable lid having a mounting flange adapted to receive said vessel rim, and wherein said vessel and said lid sealingly engage to enclose said cavity, and wherein said lid disengages from said vessel to expose said foodstuff and define a sports toy comprising aerodynamics adapted to provide variable flight patterns upon throwing.

2. The assembly of claim 1, wherein said variable flight patterns include at least a curve flight pattern and a double curve flight pattern.

3. The assembly of claim 1, wherein said upper rim comprises an outwardly flared open end portion.

4. The assembly of claim 1, wherein said upper portion comprises 0.06 inch thickness, and said lower portion comprises 0.05 inch thickness.

5. The assembly of claim 1, wherein said upper portion thickness begins between about 0.6 to about 0.8 inches above said closed end.

6. The assembly of claim 1, wherein said upper portion thickness begins 0.75 inches above said closed end.

7. The assembly of claim 1, wherein said wall comprises a length greater than a width of said vessel.

8. The assembly of claim 1, further including a foodstuff removably secured between said vessel and said lid.

9. A food vessel adapted to receive a foodstuff and subsequently throw and hit, said vessel comprising:

a. a closed end;

b. a first elastically flexible wall portion adjacent said closed end and having a first thickness;

c. a second elastically flexible wall portion extending from said first wall portion 0.75 inches above said closed end and having a second thickness, wherein said second thickness being greater than said first thickness; and d. an upper outwardly flared rim adapted to receive a corresponding lid.

10. The apparatus of claim 9, wherein said vessel having a weight distribution of a combined first elastically flexible wall portion and said second elastically flexible wall portion being greater than a weight distribution of said closed end.

11. The apparatus of claim 9, wherein a rim diameter being greater than an elastically flexible wall diameter.

12. The apparatus of claim 9, wherein said second elastically flexible wall portion positioned 0.75 inches above said closed end having aerodynamics adapted to provide a curve flight pattern upon throwing.

13. The apparatus of claim 9, wherein said second elastically flexible wall portion positioned 0.75 inches above said closed end having aerodynamics adapted to provide a double curve flight pattern upon throwing.

14. A throwing and hitting toy adapted to receive a foodstuff comprising:

a. a closed end having a planar bottom; and b. an elastically flexible body having a flat face adapted to provide a hand grip control area, and wherein said body comprising:

i. a bottom end having a first thickness, ii. a top end aligned 0.75 inches above said closed end and having a second thickness greater than said first thickness, and iii. an outwardly flared rim having a uniform thickness and adapted to receive a corresponding lid, and wherein said body adapted to provide both an effective aerodynamic curve flight pattern and an effective aerodynamic double curve flight pattern.

15. The apparatus of claim 14, including a weight distribution of said elastically flexible body being greater than a weight distribution of said closed end.

16. The assembly of claim 14, wherein a ratio between a length of said top end and a length of said bottom end is greater than two-to-one.

17. The assembly of claim 14, wherein a ratio between a diameter of said rim and said closed end is 2.4.

* * * * *